United States Patent [19]

Barwick

[11] 4,111,378

[45] Sep. 5, 1978

[54] MEANS AND METHOD FOR PROVIDING INDICATING OF END PORTION OF WEB MATERIAL

[75] Inventor: Morris L. Barwick, Deer Park, Tex.

[73] Assignee: Xerox Corporation, Stamford, Conn.

[21] Appl. No.: 802,765

[22] Filed: Jun. 2, 1977

[51] Int. Cl.[2] ..... B65H 25/14; B65H 25/32

[52] U.S. Cl. ..... 242/57; 116/67 A; 242/55; 242/74; 242/191; 400/249

[58] Field of Search ..... 242/191, 186, 189, 190, 242/57, 74, 74.1, 74.2, 67.4, 67.3, 55, 1; 116/67 A, 114 J; 197/162, 160, 163; 101/336

[56] References Cited

U.S. PATENT DOCUMENTS

| | | | |
|---|---|---|---|
| 3,572,606 | 3/1971 | Yamamoto | 242/57 X |
| 3,660,810 | 5/1972 | Yoshii | 242/57 X |
| 3,690,591 | 9/1972 | Opelt | 242/190 X |
| 3,902,585 | 9/1975 | Mogtader | 197/160 |

*Primary Examiner*—George F. Mautz

[57] ABSTRACT

Method and apparatus for providing an indication of when the web material remaining on the supply spool has been depleted to a predetermined amount, such as the end portion. An end portion of the web material is coupled to the supply spool hub and a predetermined amount of the web material is wound onto the spool in a first direction. The web material is then folded back onto itself and the remaining amount of web material to be placed on the supply spool is wound onto the spool in a second and opposite direction. As the web material is removed from the supply spool, the supply spool hub and/or the shaft for the supply spool will reverse direction of rotation upon reaching the portion of the web material, which has been folded back onto itself. Also, the angle and point of departure of the web material from the supply spool hub will change. The change in rotational direction and/or the change in the angle or point of departure of the web material from the spool are sensed to indicate the web material on the spool has been depleted to the end portion.

8 Claims, 9 Drawing Figures

MEANS AND METHOD FOR PROVIDING INDICATING OF END PORTION OF WEB MATERIAL

BACKGROUND OF THE INVENTION

This invention relates, in general, to the handling of web material and more particularly to the means and method for indicating when the web material remaining on the supply spool has been depleted to a predetermined amount, such as the end portion.

Although the invention is applicable to various web, tape, strand or ribbon-like materials, it has been found particularly useful in the environment of ink ribbons as used in serial printers. Therefore, without limiting the meaning of the word "ribbon", the invention will be described in this environment.

In devices, in which any web material is to be delivered or transferred from a rotatable reel, drum, spool, spindle or a like receptacle to another similar and compatible receptacle, it is normally desirable to provide a means to indicate when the web material is depleted from the supply spool. This is of particular importance in the environment of ink ribbons employed in serial printers, and is even more important in automatic text-editing typewriter applicaitons. Without some indication or control regarding the ribbon supply in an automatic text-editing typewriter, a portion of a page of text could be automatically typed without a supply of ribbon being available in the typewriter.

It has been known to employ various types of physical pins or clips attached to the ribbon near the end of the ribbon supply to either physically move a lever or to provide electrical contact to sense the end of the ribbon supply as disclosed in U.S. Pat. Nos. 314,016, 428,264 and 3,404,628. It is also known to employ rod or lever means, which project through the supply hub upon the depletion of the ribbon on the supply spool to sense the end-of-ribbon point as disclosed in U.S. Pat. Nos. 655,985 and 3,232,229. In U.S. Pat. Nos. 725,919, 2,251,162 and 2,458,339 a follower or lever is employed which contacts the outer periphery of the ribbon material and through its pivotal motion during the depletion of the ribbon, signals the end of the ribbon supply on the spool.

Accordingly, it is a primary object of the instant invention to develop an improved indication of the depletion of web material on a supply spool.

Another object of this invention is to obtain the occurrence of a definite action near the end portion of ribbon on the supply spool, which can be detected and acted upon as desired.

Yet another object of the current invention is to design a simple and reliable means and method for indicating the depletion of web material on a supply spool.

Other objects and advantages of the present invention will be evident from the specification and claims when read in conjunction with the accompanying drawing illustrative of the invention.

SUMMARY OF THE INVENTION

In accordance with the principles illustrative of this invention, the foregoing objects and others of the present invention, to enable a positive end-of-ribbon sensing, are accomplished by a method of placing web material onto a spool whereby, upon removal of the web material from the supply spool, the spool reverses direction of rotation when the web material remaining on the supply spool has been depleted to a predetermined amount, such as the end portion. An end portion of the web material is coupled to the spool, and a predetermined amount of web material is wound onto the spool in a first direction. The web material is then folded back onto itself, and the remaining amount of web material to be placed on the spool is wound onto the spool in a second and opposite direction. As the web material is removed from the supply spool, the supply spool will initially rotate in a first direction. When the web material has been removed from the supply spool to the point where the web material has been folded back onto itself, the supply spool will remain stationary until the folded portion has traversed around the spool. At that time, the supply spool will rotate in a second or opposite direction. The angle of and the point at which the web material departs from the supply spool will also change. Either or both the change in direction of rotation of the supply spool or the angle or point of departure of the web material from the spool may be sensed to provide an indication that the web material has been depleted to the predetermined amount remaining on the spool, which is normally the end portion of the web material.

BRIEF DESCRIPTION OF THE DRAWING

Other advantages and features of the present invention may become more apparent from reading the following detailed description in connection with the drawing forming a part thereof, in which.

DESCRIPTION OF THE PREFERRED EMBODIMENT

Figure 1A:
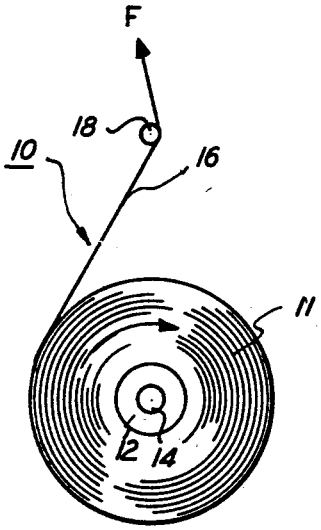
FIG. 1A is a top plan view of a full supply spool of web material prepared in accordance with the present invention.
Figure 1B:
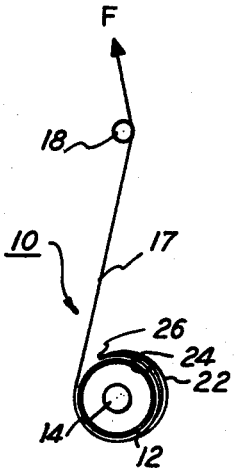
FIG. 1B is a top plan view of FIG. 1A shown at the time or point of transition.
Figure 1C:
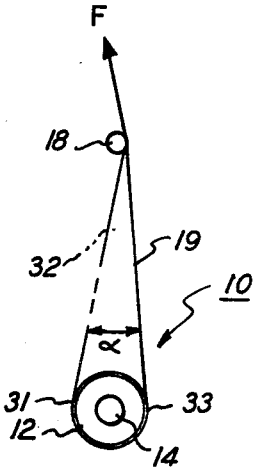
FIG. 1C is a top plan view of FIG. 1A shown subsequent to the time or point of transition.

Referring now to the drawing and more particularly FIGS. 1A–1C, there are shown simplified views of one embodiment of the means and method for providing indication of the end portion of web material of the present invention.

With reference to FIG. 1A, there is shown a simplified view of a web or ribbon supply means 10 comprising a full spool of web or ribbon material 11 wound or wrapped around hub 12. Hub 12 is supported for rotational movement on or by shaft or spindle 14. One end portion 16 of ribbon material 11 extends from the outer periphery of the ribbon supply means 10 to and past ribbon guide or post 18. Post 18, although not necessary for the operation of the present invention, is desirable for smooth operation of the transfer of the web or ribbon material 11 from the ribbon supply means 10 to the ribbon take-up means (not shown) by providing a substantially constant point or angle of approach of the ribbon material 11 to the ribbon take-up means (not shown) and a reference point for the ribbon material 11 leaving the ribbon supply means 10. Force F depicts the force applied to the ribbon material 11 by the ribbon take-up means to unwind the ribbon material 11 from the ribbon supply means 10 and transfer the ribbon material 11 to the ribbon take-up means. In the embodiment shown in FIG. 1A, when force F is applied to the end portion 16 of ribbon material 11, the ribbon supply means 10 will initially rotate in a clockwise direction.

Referring now to FIG. 1B, there is shown the ribbon supply means 10 with the ribbon material 11 having been transferred from the ribbon supply means 10 to the ribbon take-up means (not shown) in such an amount that the time or point of transition has been reached and hub 12 is stationary even though ribbon material 11 is being removed from the ribbon supply means 10 by force F.

Referring now to FIG. 1C, there is shown the ribbon supply means 10 with the ribbon material 11 having been transferred from the ribbon supply means 10 to the ribbon take-up means (not shown) in such an amount that the time or point of transition has passed and hub 12 is rotating in a counterclockwise direction as ribbon material 11 is being removed from the ribbon supply means 10 by force F. As is understood, the counterclockwise direction of rotation of hub 12 in FIG. 1C is opposite to the clockwise direction of rotation of hub 12 in FIG. 1A when the ribbon supply means 10 was essentially full of ribbon material 11.

With reference to FIGS. 1B and 1C, the ribbon material 11 is wound or wrapped around hub 12 by initially coupling or attaching end portion 19 of ribbon material 11 to hub 12. End portion 19 comprising a predetermined amount in length is wound or wrapped in a counterclockwise direction onto hub 12. In order to accomplish the same result, the hub 12 could be rotated in a clockwise direction to place the predetermined amount of ribbon material 11 onto hub 12. After the predetermined amount of ribbon material 11 is placed on hub 12, the ribbon material 11 is folded back onto itself to provide ribbon fold 26. The side of the ribbon material 11, which was the inner side 24 and was in a facing relationship toward hub 12 prior to the point in the ribbon material 11 where the ribbon fold 26 occurred, now becomes the outer side 22 and is in a facing relationship away from hub 12, subsequent to the ribbon fold 26. After this fold-back of the ribbon material 11 occurs, the remaining ribbon material to be placed onto hub 12 is wound or wrapped in a clockwise direction onto hub 12. In order to accomplish the same result, the hub 12 could be rotated in a counterclockwise direction to place the remaining desired amount of ribbon material 11 onto hub 12. After the desired amount of ribbon material 11 has been placed onto hub 12, the ribbon supply means 10 will appear as depicted in FIG. 1A.

In operation of the transfer of the ribbon material 11 from the ribbon supply means 10 to the ribbon take-up means (not shown) in the particular disclosed embodiment, the ribbon supply means 10 will, for example, initially rotate in a clockwise direction, as shown in FIG. 1A, as ribbon material 11 is removed from the ribbon supply means 10. When ribbon material 11 has been removed from the ribbon supply means 10 in the amount that the ribbon fold 26 has been uncovered by having ribbon portion 17 removed from around hub 12, as shown in FIG. 1B, the rotation of hub 12 ceases. Hub 12 is stationary until force F removes ribbon material 11 from hub 12 forcing ribbon fold 26 to move or traverse around hub 12 in a clockwise direction and then toward ribbon guide or post 18. Subsequent to this occurrence, end portion 19 of ribbon material 11 will be removed from hub 12 on the side or point 33 of hub 12 opposite to the side or point 31 of hub 12 from which the ribbon material 11 was being removed prior to the point or time of transition and hub 12 will now be caused to rotate in a counterclockwise direction.

It should be understood that the same concept would apply if the directions of winding the ribbon material 11 onto hub 12 were reversed from those detailed in the example above. Under these conditions, FIGS. 1A–1C would be mirror images of the present figures and the directions of unwinding would also be reversed.

Figure 2:
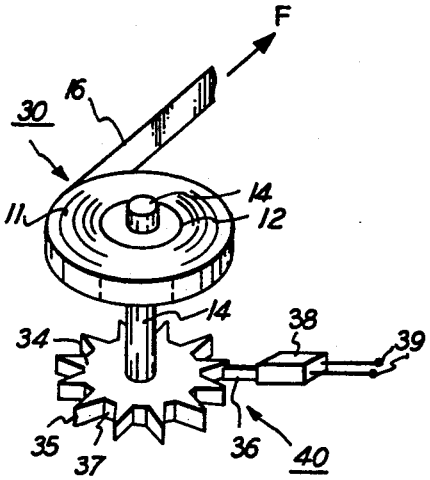
FIG. 2 is a perspective view of one embodiment according to the invention herein showing the sensing means.

Referring now to FIG. 2, there is shown a simplified view of one embodiment of a ribbon supply means 30 and sensing means 40 positioned in operative relationship with each other. Ribbon supply means 30 comprises a full spool of ribbon material 11 wound or wrapped around hub 12 in the manner depicted in FIGS. 1A–1C. Hub 12 is supported by any well known means (a key way, i.e.) for rotational movement with shaft 14. Sensing means 40 includes switch 38 with leads 39 and flexible activation member or lever 36 together with hub or wheel 34 attached to shaft 14 and having teeth or gear projections 35 arranged in a star-type configuration. Activation member or lever 36 is positioned or protrude between the projections 35 to a depth to enable the projections 35 to physically move member 36 when wheel 34 is rotated. When wheel 34 is rotated in a first direction, for example, clockwise, projections 35 cause member 36 to pivot counterclockwise, resulting in switch 38 being turned on or activated with a continuity existing between leads 39. The flexible property of member 36 enables member 36 to ride over the outermost points of projections 35 and then snap down into the valleys 37 between the projections 35 as wheel 34 is rotated. When the direction of rotation of wheel 34 and the ribbon supply means 30 is reversed, projections 35 cause member 36 to pivot clockwise, resulting in switch 38 being turned off or inactivated with discontinuity existing between leads 39. This condition of discontinuity between leads 39 could be used to inactivte the ribbon take-up means (not shown). It should be understood that switch 38 could be the type to provide the reverse conditions of continuity and discontinuity for the same positions of member 36 as discussed above.

In operation of the embodiment of FIG. 2, when force F is applied to the end portion 16 of ribbon material 11, ribbon supply means 10 will initially rotate in a clockwise direction with hub 12, shaft 14 and wheel 34 also rotating in a clockwise direction. Activation member or lever 36 is pivoted counterclockwise to keep switch 38 activated or on. The above relationship wil exist during the removal of the ribbon material 11 from the ribbon supply means 30 to the ribbon take-up means (not shown) until the ribbon material 11 has been removed in such an amount that the time or point of transition has been reached and ribbon fold 26 (FIG. 1B) has been uncovered. At this time, rotation of hub 12, shaft 14 and wheel 34 ceases but ribbon material 11 continues to be removed from hub 12 because ribbon fold 26

(FIG. 1B) and accompanying ribbon material 11 is moved or traversed around hub 12 and toward the ribbon drive means. Hub 12 remains essentially stationary while the ribbon drive means removes ribbon material 11 from the ribbon supply means 30, until the loosely wound turn of ribbon material 11, including ribbon fold 26, is removed from the ribbon supply means 30. At this time, the ribbon material 11 will be removed or exiting from hub 12 on the side or portion of hub 12 opposite to the side or portion of hub 12 from which the ribbon material 11 was being removed when hub 12 was being rotated in a clockwise direction. As the ribbon material 11 continues to be removed from the ribbon supply means 30, hub 12 will start and continue to rotate in a counterclockwise direction until the remaining ribbon material is removed from hub 12 or until the ribbon drive means is inactivated. When wheel 34 changes direction of rotation from clockwise to counterclockwise, projections 35 cause member 36 to pivot clockwise and turn off or inactivate switch 38.

Figure 3:
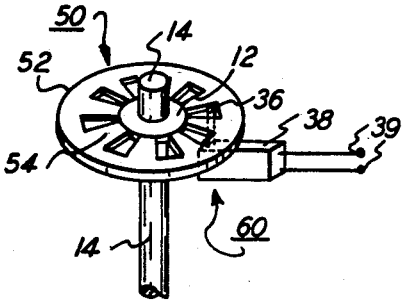
FIG. 3 is a perspective view of another embodiment according to the invention herein showing another sensing means.

Referring to FIG. 3, there is shown a simplified view of another embodiment according to the present invention showing another means for sensing the transition or change in rotation of the ribbon supply means 50. Ribbon supply means 50 is shown without ribbon material wound thereon in order to provide clarity to the hub 12. Hub 12 is supported for rotational movement by shaft 14. Beams 54 extend radially outwardly from hub 12 and terminate in rim 52 to provide a spoked flange arrangement beneath any ribbon wound around hub 12. Sensing means 60 includes switch 38 with leads 39 and flexible activation member or lever 36. Activation member or lever 36 is positioned to protrude between beams 54 to a depth to enable the beams 54 to physically move member 36 when the hub 12 and beams 54 are rotated. The operation of switch 38, as shown in the embodiment of FIG. 3, is similar to that of FIG. 2. When the beams 54 rotate in a first direction member 36 is pivoted to the on position by beams 54, and when the beams 54 are rotated in a second and opposite direction, member 36 is pivoted to the off position. As long as the rotational movement of beams 54 is in one direction, member 36 stays in one position by contact with beams 54.

Figure 4A:
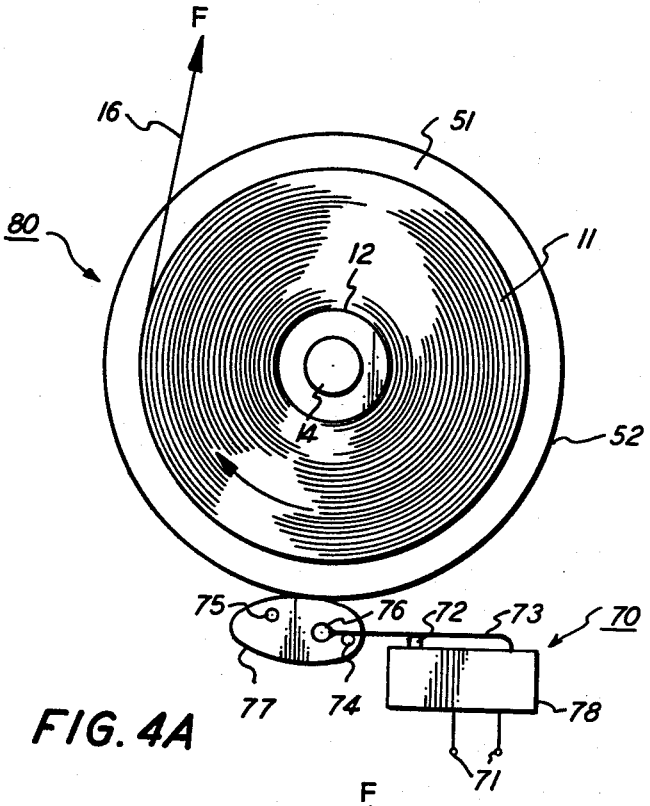
FIGS. 4A and 4B are top plan views of another embodiment according to the invention herein showing another sensing means.

Referring to FIG. 4A, there is shown a simplified view of another embodiment according to the present invention showning another means for sensing the transition or change in rotation of the ribbon supply means 80. Ribbon supply means 80 comprises a full spool of ribbon material 11 wound or wrapped around hub 12 in the manner depicted in FIGS. 1A–1C. Hub 12 includes flange 51 and rim 52 which are positioned beneath ribbon material 11. Hub 12 is supported for rotational movement with or by shaft 14. Sensing means 70 includes switch 78 with leads 71, flexible actuation member or lever 73, and movable post 72. Lever 73 is operatively positioned with respect to post 72 to provide actuation of switch 78 through movement of post 72. Switch 78 is positioned such that the end of lever 73 extending away from switch 78 is positioned around pin 76. Eccentric roller 77 is mounted for pivotal movement about pin 76. Pin 76 is mounted for radial movement with respect to hub 12 and is resiliently biased toward hub 12 such that the periphery of roller 77 is in contact with rim 52. Rotation limit pins 74 and 75, in cooperation with lever 73, limit the degree of rotation of eccentric roller 77.

Figure 4B:
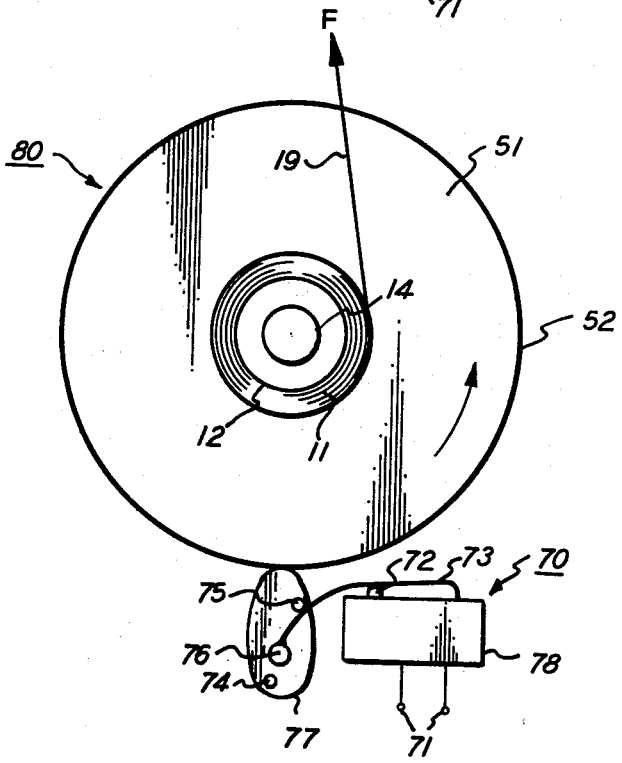

In operation of the embodiment of FIG. 4A, when force F is applied to the end portion 16 of ribbon material 11, ribbon supply means 80 will initially rotate in a clockwise direction. The clockwise rotation of rim 52 will cause eccentric roller 77, which is in contact with rim 52, to rotate in a counterclockwise direction about pin 76 until pin 74 comes in contact with lever 73. Upon the contacting of lever 73 with pin 74, eccentric roller 77 ceases to rotate and sliding frictional contact occurs between the moving rim 52 and the stationary roller. Also, lever 73 is forced generally toward hub 12 and away from movable post 72, switch 78 is not activated and discontinuity exists between leads 71. The above relationship will exist during the removal of the ribbon material 11 from the ribbon supply means 80 until the ribbon material 11 has been removed in such an amount that the time or point of transition has passed. After the time or point of transition has passed, the ribbon material 11 will be removed or will exit from hub 12 on the side or portion of hub 12 which is opposite to the side or portion of hub 12 from which the ribbon material 11 was being removed prior to the time or point of transition and hub 12 will rotate in a counterclockwise direction, as shown in FIG. 4B. When hub 12 starts to rotate in a counterclockwise direction, eccentric roller 77 will rotate in a clockwise direction around pin 76 and pin 76 will move in a radial direction away from hub 12. This movement will continue until pin 75 comes in contact with lever 73 whereupon eccentric roller 77 ceases to rotate and sliding frictional contact again occurs between the moving rim 52 and the stationary roller 77. The movement of pin 76 away from hub 12 together with the movement of pin 75 against lever 73 cause pin 72 to be depressed, activating switch 78 and providing continuity between leads 71. It should be understood that switch 78 could be positionally rotated with respect to lever 73 such that switch 78 would be activated by the conditions shown in FIG. 4A and be inactivated by the conditions of FIG. 4B. In addition, switch 78 could be the type to provide the reverse conditions of continuity and discontinuity for the same conditions shown in FIGS. 4A and 4B.

Figure 5A:
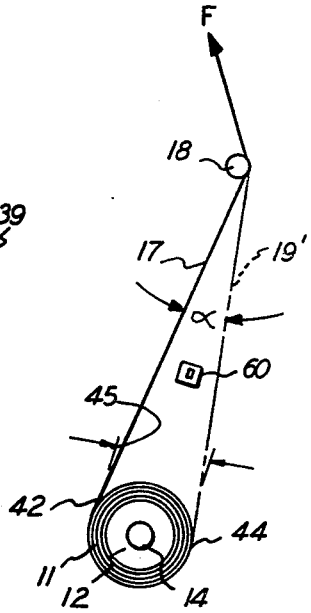
FIG. 5A is a top plan view of a supply spool of web material showing the change in the angle of departure of the web material from the spool and the distance traversed by the web material.
Figure 5B:
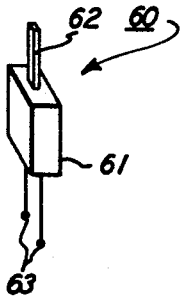
FIG. 5B is a perspective view of the switch means of FIG. 5A.

Referring to FIGS. 5A and 5B, there is shown a simplified view of another embodiment according to the present invention showing how the arrival of the end portion 19' of the ribbon material 11 may be sensed by sensing the change in angle through which the end portion 19' passes or the change in the point of departure of the end portion 19' from hub 12 by sensing the traverse movement of end portion 19'. Hub 12 is supported for rotational movement by or with shaft 14. Ribbon material 11 was previously wound around hub 12 in the manner depicted in FIGS. 1A–1C. The solid line from hub 12 to ribbon guide or post 18 depicts ribbon portion 17, which is that portion of ribbon material 11 removed from hub 12 prior to the point where the ribbon fold 26 (not shown in FIG. 5A) occurs and while hub 12 is still rotating clockwise. The dotted line from hub 12 to ribbon guide or post 18 depicts end portion 19', which is that portion of ribbon material 11 removed from hub 12 subsequent to the point where the ribbon fold 26 (not shown in FIG. 5A) occurs and the transition time or point has occurred and hub 12 is now rotating counterclockwise. It should be understood that ribbon material 11 (ribbon portion 17 and end portion 19') has traversed through an angle $\alpha$, with respect to ribbon guide 18, as the rotational motion of hub 12 goes from clockwise to nonrotation to counterclockwise. In addition, ribbon material exits from hub 12 at point 42 prior to the transition and exits from hub at point 44 after the transition with points 42 and 44 being essentially 180° from each other on hub 12. End portion 19' has traversed a distance 45 measured perpendicular to a line bisecting angle $\alpha$ and tangent to the periphery of the ribbon material 11 on hub 12. Ribbon guide or post 18 is shown as a point of reference, but the ribbon material will also travel or traverse an angle, such angle being different than the angle if the ribbon material 11 goes directly to the ribbon take-up means, such as another spool, etc. The value of the angle will vary depending upon the distance of the take-up means from the ribbon supply means. The change in angle or the angle traversed or the traverse movement by the ribbon is sensed by sensing means 60. As shown in FIG. 5B, a microswitch 61 would be suitable, with the activation member 62 being positioned in the path of travel of the ribbon such that the member 62 would be contacted as the ribbon traverses angle $\alpha$. As the ribbon moves member 62, thereby tripping switch 61, discontinuity is provided with respect to leads 63 to shut off the ribbon take-up means.

While the principles of the invention have been made clear in the illustrative embodiments, it is apparent that alternatives, modifications and variations will be evident to those skilled in the art. Accordingly, it is intended to embrace all alternatives, modifications and variations as fall within the spirit and broad scope of the appended claims.

What is claimed is:

1. Apparatus for sensing the end portion of the web material in a web transfer apparatus including web take-up means, the combination comprising:

a rotatably supported supply spool, web material having an end portion coupled to the supply spool, said web having a first predetermined amount including the end portion positioned around the supply spool in a first direction and having a second predetermined and remaining amount positioned around the supply spool in a second and opposite direction whereby the supply spool rotates in a first direction during the removal of the second predetermined amount of web material and rotates in a second and opposite direction during the removal of the first predetermined amount of web material, and means to sense the change in direction of the rotation of the supply spool.

2. Apparatus as set forth in claim 1 wherein said sensing means includes a switch positioned in operative relationship with said spool whereby said switch is activated by said spool upon reversal of direction of rotation of said spool.

3. Apparatus as set forth in claim 1 wherein said sensing means includes a switch positioned in operative relationship with said spool whereby said switch is inactivated by said spool upon reversal of direction of rotation of said spool.

4. Apparatus as set forth in claim 1 where said supply spool is supported by a shaft which rotates with said spool and said sensing means includes a switch positioned in operative relationship with said shaft whereby said switch is activated by said shaft upon reversal of direction of rotation of said shaft.

5. Apparatus as set forth in claim 1 wherein said supply spool is supported by a shaft which rotates with said spool and said sensing means includes a switch positioned in operative relationship with said shaft whereby said switch is inactivated by said shaft upon reversal of direction of rotation of said shaft.

6. Apparatus for sensing the end portion of the web material in a web transfer apparatus including web take-up means, the combination comprising:

a rotatably supported supply spool, web material having an end portion coupled to the supply spool, said web having a first predetermined amount including the end portion positioned around the supply spool in a first direction and having a second predetermined and remaining amount positioned around the supply spool in a second and opposite direction whereby during the removal of the second predetermined amount of web material, the web material exists from the supply spool at a first predetermined location and during the removal of the first predetermined amount of web material, the web material exits from the supply spool at a second predetermined location located substantially 180° around the periphery of the supply spool from the first predetermined location, and means to sense a movement of the web material when said web material traverses from the first exit location to the second exit location on the supply spool.

7. Apparatus as set forth in claim 6 wherein said sensing means includes a switch.

8. A method of positioning web material onto a supply spool whereby upon removal of the web material from the supply spool, the supply spool reverses direction of rotation when the web material remaining on the supply spool has been depleted to a predetermined amount, said method comprising the steps of:

coupling an end portion of the web material to the supply spool, positioning a predetermined amount of web material around the supply spool in a first direction, folding the web material back onto itself, and positioning the remaining amount of web material around the supply spool in a second and opposite direction.

* * * * *